United States Patent [19]

Jantzen, Jr.

[11] 3,974,582

[45] Aug. 17, 1976

[54] PLATEN FOR STRIP-UP MICROFICHE

[75] Inventor: Johannes Kristoffer Jantzen, Jr., Mountain View, Calif.

[73] Assignee: Addressograph Multigraph Corporation, Cleveland, Ohio

[22] Filed: Jan. 24, 1975

[21] Appl. No.: 543,813

[52] U.S. Cl. ..... 40/106.1; 33/184.5; 101/415.1; 355/75; 282/29 B

[51] Int. Cl.[2] ..... G09F 3/12

[58] Field of Search ..... 40/106.1, 125 G; 355/76, 75, 72; 33/184.5; 101/415.1; 38/102.4, 102.91, 102.5, 102.6, 102.9; 160/378; 282/29 B

[56] References Cited

UNITED STATES PATENTS

| | | | |
|---|---|---|---|
| 2,109,066 | 2/1938 | Haskell et al. | 282/29 B X |
| 2,262,278 | 11/1941 | Godley | 282/29 B X |
| 2,288,267 | 6/1942 | Cochran et al. | 101/415.1 |
| 2,512,940 | 6/1950 | Janke | 101/415.1 |
| 3,188,652 | 6/1965 | Van Horne et al. | 101/415.1 X |
| 3,226,861 | 1/1966 | Bird | 160/378 X |
| 3,695,760 | 10/1972 | Orr | 33/184.5 X |

FOREIGN PATENTS OR APPLICATIONS

| | | | |
|---|---|---|---|
| 528,030 | 10/1940 | United Kingdom | 282/29 B |

*Primary Examiner*—John F. Pitrelli
*Attorney, Agent, or Firm*—Michael A. Kondzella

[57] ABSTRACT

A platen for a strip-up microfiche is equipped with a plurality of pin holders, half of which are fixed in position on one edge of the platen frame and the other half of which are movable seriatim within the opposite edge of the frame to grasp or release the edge of the microfiche which is not connected to the fixed pin holders.

3 Claims, 9 Drawing Figures

PLATEN FOR STRIP-UP MICROFICHE

BACKGROUND OF THE INVENTION

This invention relates to a platen for a strip-up microfiche. In one of its more particular aspects this invention concerns a platen which is equipped with releasable holders for maintaining a strip-up microfiche in a substantially planar configuration.

Microfilm is being used today to an ever increasing extent as the information explosion makes the retention of records a formidable problem. Microfilm records can be stored in a fraction of the space required by originals and are therefore used to take optimum advantage of the storage space available.

Various microfilm formats are available including roll film, microcards and microfiche. Microfiche usage involves copying records upon an integral sheet of microfilm which contains a plurality of information-containing frames, sometimes as many as over one hundred, arranged in columns and rows. It is sometimes desirable, for the purpose of updating records, for example, to be able to change a part of the microfiche, for example a single frame thereof, without having to produce a completely new microfiche. For this purpose a variation of microfiche popularly known as a strip-up microfiche is used. In order to make a change in this type of microfiche, which consists of strips of microfilm, corresponding in number to the number of rows in the microfiche, which are adhered to each of two perforated edge strips, it is necessary only to remove the one strip which is to be changed and to replace it with a strip containing the updated or otherwise corrected information.

In use microfilm records, as in the case of other record storage media, must frequently be reproduced. Machines for duplicating microfiche are equipped with optical systems which expose a film, such as a diazo film, in order to produce thereon an image corresponding to the microfiche to be duplicated. In order to obtain a duplicate which is an accurate reproduction of the original microfiche, it is necessary that the positioning of the original be carefully controlled. The microfiche must be accurately placed in the optical path of the machine with the angular disposition of the original with respect to the optical path being such that no distortion is introduced into the duplicate. In the case of strip-up microfiche in particular it is essential that a planar configuration of the original microfiche be maintained. Since, however, the strip-up microfiche tends to bow at the middle it has been found necessary to devise means to hold the microfiche flat during the duplicating process. The systems heretofore devised tend to be somewhat unsatisfactory principally because they are less than one hundred percent effective or have proved to be cumbersome.

OBJECTS

It is therefore an object of this invention to provide an improved platen for a strip-up microfiche.

Another object of this invention is to provide improved means for holding a strip-up microfiche in a planar configuration.

A further object of this invention is to provide a platen for holding a strip-up microfiche which is convenient to use.

Other objects and advantages of this invention will become apparent in the course of the following detailed disclosure and description.

SUMMARY OF THE INVENTION

A platen for strip-up microfiche is equipped with a set of holders at each of two opposing edges of the platen frame. One set of holders is fixed. Each holder of the other set is movable to lock a strip-up microfiche in place on a transparent carrier enclosed by the frame or to release the microfiche from its locked condition. Movement of the holders is effected by means of a tool which moves the pins seriatim upon insertion into the platen frame.

THE DRAWING

DESCRIPTION OF THE PREFERRED EMBODIMENTS

Figure 1:
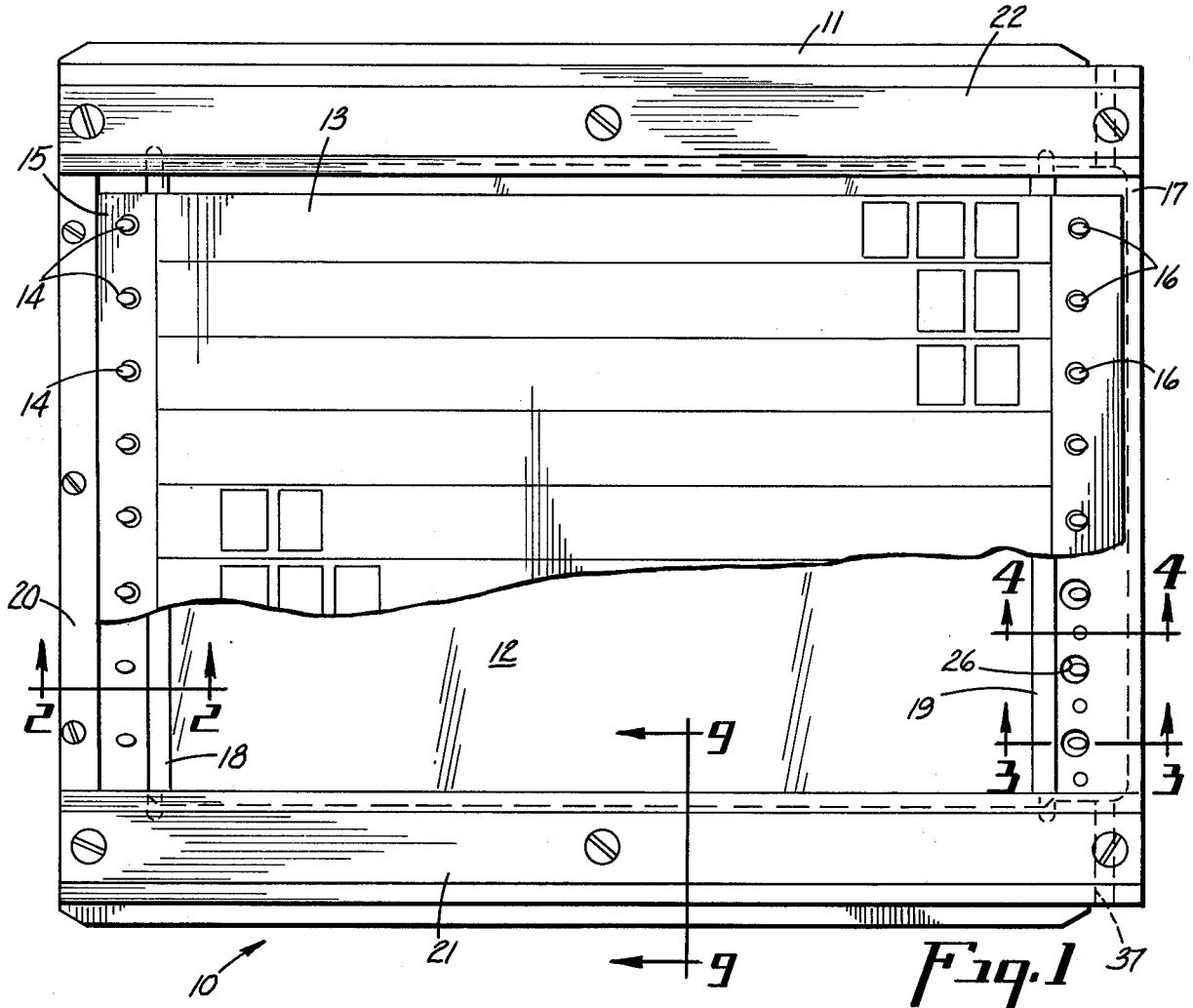
FIG. 1 is a plan view of a platen according to this invention showing a strip-up microfiche, partly broken away, in position thereon.
Figure 2:
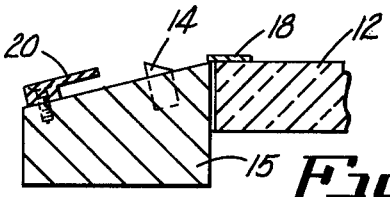
FIG. 2 is an enlarged cross-section taken along the line 2—2 of FIG. 1.
Figure 3:
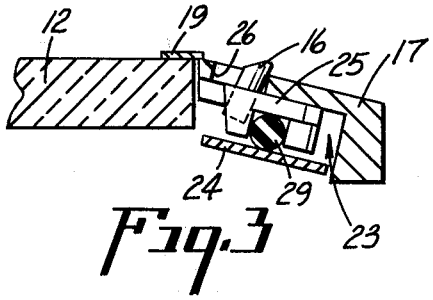
FIG. 3 is an enlarged cross-section taken along the line 3—3 of FIG. 1.
Figure 5:
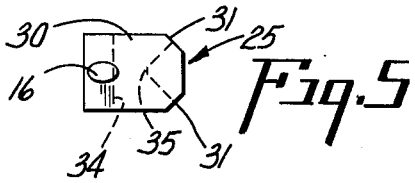
FIG. 5 is a plan view of a latch assembly utilized in the platen.
Figure 4:
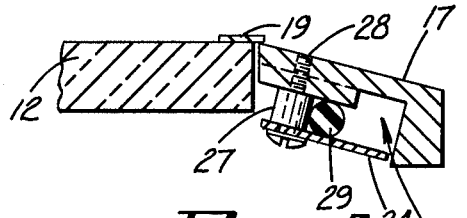
FIG. 4 is an enlarged cross-section taken along the line 4—4 of FIG. 1.
Figure 6:
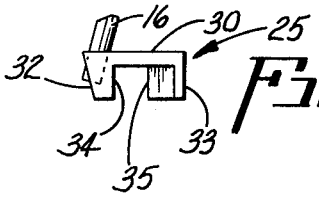
FIG. 6 is a side elevation thereof.

Referring to FIG. 1 there is shown a platen 10 consisting of frame 11 and glass carrier 12. Strip-up microfiche 13 is shown attached to pins 14 along the left-hand edge 15 of frame 11 and pins 16 along the right-hand edge 17 thereof. Pins 14 are fixed in position in the left-hand edge 15 of frame 11 as shown in FIG. 2. Masks 18 and 19 retain glass carrier 12 upon frame 11 at the left and right edges, respectively. Retainer bar 20 is attached to left-hand edge 15 of frame 11 and functions to hold the left-hand edge of microfiche 13 in a position to facilitate engagement of microfiche 13 by pins 14. Glass carrier clamps 21 and 22 hold glass carrier 12 in position upon frame 11 at the lower and upper edges respectively.

The right-hand edge 17 of frame 11 contains a cavity 23 enclosed at the top by righ-hand edge 17 of frame 11 and mask 19, at the bottom by retainer 24, on the right side by edge 17 and on the left side by the right-hand edge of glass carrier 12. Within cavity 23 are positioned a plurality of latch assemblies 25 adapted to slide transversely within cavity 23 within the limits of holes 26 in edge 17. Also positioned within cavity 23 are a series of spacers 27 which surround screws 28 holding retainer 24 in a position spaced from edge 17. An elastomeric cord 29, such as a rubber cord, is positioned within cavity 23 on the underside of latch assemblies 25 and abutting spacers 27. Cord 29 extends generally longitudinally the length of cavity 23.

Latch assemblies 25 each consists of pin 16 and pin support base 30. The top surface of base 30 is generally rectangular shaped with chamfers 31 at one edge thereof. The bottom of base 30 has legs 32 and 33. Leg 32 has a vertical edge 34 and leg 33 terminates in inwardly directed point 35.

Figure 7:
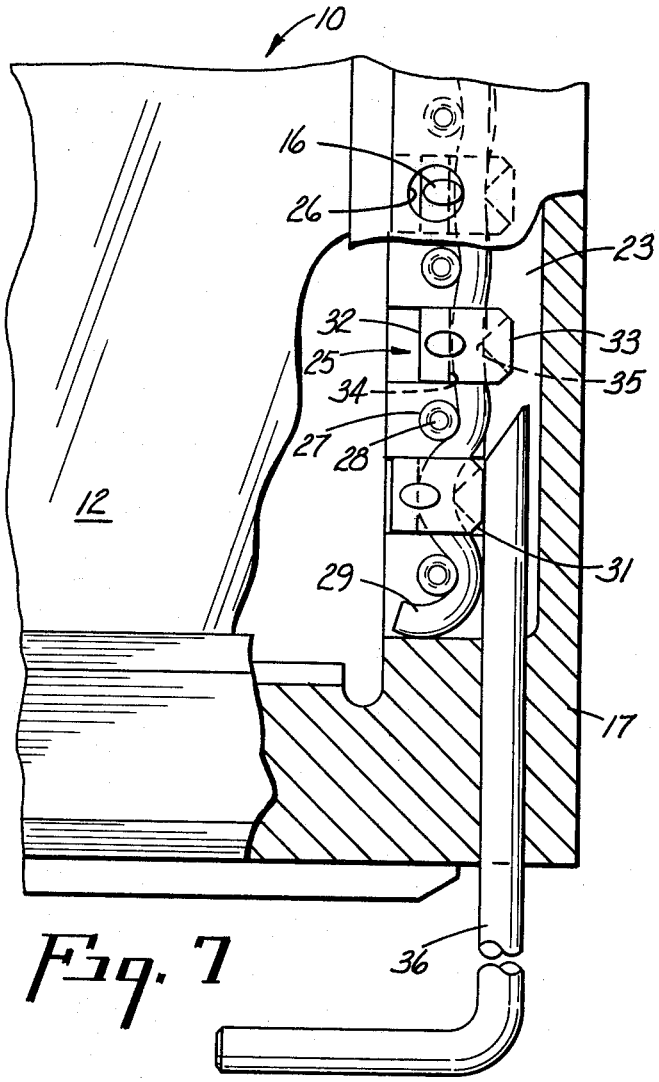
FIG. 7 is an enlarged plan view, partly broken away, showing a tool partly inserted into the platen and the first of a series of movable latch assemblies in its release position.
Figure 8:
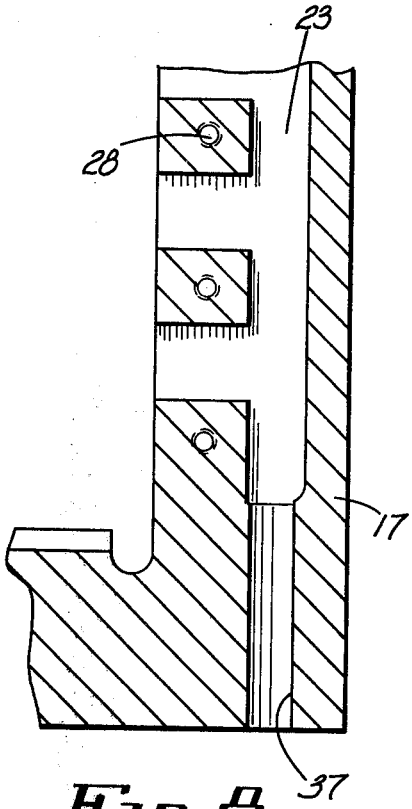
FIG. 8 is a view like FIG. 7 with the tool and latch assemblies removed.
Figure 9:
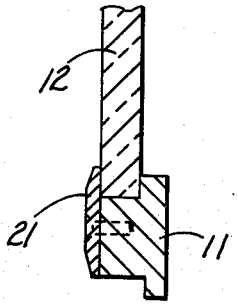
FIG. 9 is an enlarged cross-section taken along the line 9—9 of FIG. 1.

The operation of the platen will be illustrated with reference to FIGS. 7 and 8. In its normal position pins 16 are positioned to the right within holes 26. Cord 29 is loosely positioned within the grooves formed between legs 32 and 33 of latch assemblies 25 and abuts vertical edges 34 and points 35 as well as spacers 27.

In order to load platen 10 a loading tool 36 is inserted into an opening 37 leading into cavity 23. The tapered end of tool 36 contacts chamfers 31 of each of latch assemblies 25 as it is moved longitudinally towards the upper edge of platen 10 within cavity 23 causing each of latch assemblies 25 to move to the left seriatim against the elastic force exerted by cord 29 which is held against a spacer 27 on each side of a latch assembly 25 as point 35 advances to the left against cord 29. Movement of latch assemblies 25 causes pins 16 to move to the left within the limits of holes 26. As the loading tool is pushed home within cavity 23 each of latch assemblies 25 is caused to move to the left seriatim.

To load a microfiche upon the platen of this invention it is necessary merely to place the left-hand edge of the microfilm under retainer bar 20 so that the fixed pins 14 are contained within the holes in the left-hand edge of the microfiche and to inset a suitable loading tool to force movable pins 16 seriatim into their release position. The microfiche is then positioned so that each of the movable pins 16 is contained within a hole in the right-hand edge of the microfiche and the loading tool is withdrawn causing the pins 16 to spring seriatim to their latching position thereby holding the microfiche securely and in a substantially planar configuration.

This invention has been described with reference to specific embodiments thereof. However, it is to be understood that other embodiments may be used to achieve the results of this invention. It is therefore intended that this invention is not to be limited except as defined in the following claims.

I claim:

1. A platen for a strip-up microfiche comprising a frame, a transparent carrier enclosed by said frame, a series of fixed holders in one edge of said frame and a series of independently movable holders in the opposite edge of said frame, wherein said fixed holders and said movable holders cooperate to hold a strip-up microfiche and said movable holders release said microfiche upon uniform serial movement of said movable holders, each of said movable holders is a latch assembly comprising a pin, a pin support base having an upper and lower surface, and a groove in said lower surface and wherein a resilient member is positioned in said grooves, said latch assemblies being biased against said resilient member.

2. A platen according to said claim 1 wherein said pin support base has a chamfered edge and said biasing is effected by means of a tapered tool which impinges upon said chamfered edge of each pin support base seriatim upon insertion into the platen.

3. A platen according to claim 1 wherein said resilient member is an elastomeric cord.

* * * * *